US006724288B1

(12) United States Patent
Mc Queen

(10) Patent No.: US 6,724,288 B1
(45) Date of Patent: Apr. 20, 2004

(54) TRANSFORMERS TUBE TYPE

(76) Inventor: Clarence W Mc Queen, P.O. Box 781, Hailey, ID (US) 83333

( * ) Notice: Subject to any disclaimer, the term of this patent is extended or adjusted under 35 U.S.C. 154(b) by 0 days.

(21) Appl. No.: 08/897,484

(22) Filed: Jul. 21, 1997

(51) Int. Cl.[7] ..... H01F 27/02
(52) U.S. Cl. ..... 336/83; 336/212; 336/221
(58) Field of Search ..... 336/182, 90, 212, 336/220–222, 180, 183, 185, 83, 145–147, 260

(56) References Cited

U.S. PATENT DOCUMENTS 2,608,610 A * 8/1952 Thulin
2,628,342 A * 2/1953 Taylor
2,703,389 A * 3/1955 Schwartz, Jr. ..... 336/182
2,965,864 A * 12/1960 Patka et al.
3,020,527 A * 2/1962 MacLaren ..... 336/182
3,445,928 A * 5/1969 Beynon ..... 336/182
3,638,150 A * 1/1972 Zwobada et al. ..... 335/153
4,060,761 A * 11/1977 Rhodes ..... 324/43
4,117,436 A * 9/1978 MacLennan ..... 336/65
4,456,900 A * 6/1984 Toyoshima et al. ..... 336/221
4,675,638 A * 6/1987 Szabo ..... 336/83
4,891,980 A * 1/1990 Kawai et al. ..... 73/290 R
4,943,793 A * 7/1990 Ngo et al. ..... 336/83
5,101,803 A * 4/1992 Najamura et al. ..... 123/634
5,450,052 A * 9/1995 Goldberg et al. ..... 336/83

* cited by examiner

*Primary Examiner*—Elvin Enad
*Assistant Examiner*—Tuyen T. Nguyen

(57) ABSTRACT

A ferromagnetic tube, with an electric current passing through a conductor coiled on the outside of the tube, will produce a magnetic field on the inside of said tube when the tube is long relative to the diameter and will produce a magnetic field on the outside when the tube is short relative to the diameter. With a ferromagnetic center post, placed axially within said tube and with ferromagnetic end caps, connecting the center post to the tube, a conductor coiled on the center post will produce a magnetic field on the outside of the tube when the tube is long relative to the diameter and on the inside of the tube when the tube is short relative to the diameter. This phenomena has direct applications to charged particle containment, electromagnets, transformers and other inductive devices.

3 Claims, 2 Drawing Sheets

TRANSFORMERS TUBE TYPE

BACKGROUND OF THE INVENTION

This invention relates to the positioning of magnetic fields in or around ferromagnetic tubes for applications relating to transformers, other inductive device and to the containment of charged particles.

Inclosed magnetic fields are currently produced or contained utilizing the Rowland Ring principle, the magnetic bottle, the magnetic mirror and the Tokamak or torodial wound hollow torus. The Rowland Ring principle is used extensively in the production of core and shell type transformers.

SUMMARY OF THE INVENTION

It is the object of my invention to provide an improved transformer by reducing the core weight.

It is another object of my invention to reduce stray magnetic fields emanating from an inductive device and the effect of stray external magnetic fields on an inductive device.

It is another object of my invention to provide improved inductive devices by reducing flux leakage.

It is another object of my invention to provide a simplified method of containment and ordering of charged particles.

The aforementioned and other objects of this invention are achieved by the utilization of ferromagnetic tubular construction, with current carrying conductors, wound on the tube or core. These conductors are insulated from the core and other conductors [insulation not shown in the drawings]. When an electric current passes through a conductor wound on the outside of a ferromagnetic tube that is long, 7 or more times the diameter, the resultant magnetic field will be on the inside of the tube. With two end caps and a center post of a ferromagnetic material added and with electric current passing through a conductor, wound on the center post, a magnetic field will be produced on the outside of the tube.

When an electric current passes through a conductor wound on the outside of a ferromagnetic tube that is short, 1½ or less times the diameter, a magnetic field will be produced on the outside of the tube. With two end caps and a center post of ferromagnetic material added and with electric current passing through the conductor on the center post, a magnetic field will be produced on the inside of the tube.

When a current carrying conductor is wound on the outside of a long ferromagnetic tube, 7 or more times the diameter, the resultant magnetic field inside said tube will impose an ordered arrangement on charged particles placed inside of said tube.

The almost complete containment of the magnetic field within the magnetic tube, when said tube is short relative to the diameter and with the current carrying conductor wound on the center post, an effective current modifier or controller results.

DESCRIPTION OF THE PREFERRED EMBODIMENT

Figure 8:
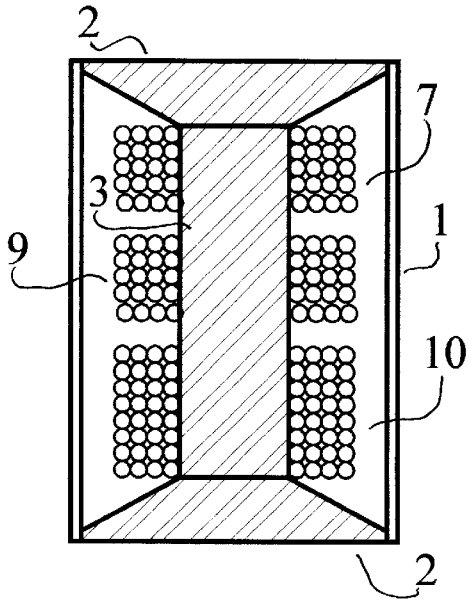
FIG. 8. This is a cross sectional drawing [split down the center] and is similar to FIG. 6 with the addition of two more conductor coils. This arrangement can be a transformer with primary and secondary coils and a fluxgate with signal, power and trigger coils primarily used on inverter systems or other inductive devices.

Referring to FIG. 8. This unit consists of a short tube #1, 1½ or less times the diameter, with a center post #3 located axially inside of tube #1, two end caps #2 in contact with the center post and with the tube. Conductors #7, #9 and #10 are coiled on center post #3. When a changing or alternating current passes through conductor #7 wound on center post #3 a changing magnetic field is produced and contained within a space bounded by the end caps #2 and tube # 1. This changing magnetic field then produces secondary currents in conductor coils #9 and #10. This action results in transformer or other inductive devices. The end caps #2 and tube #1 also contain the magnetic field within as well as shield against magnetic fields from without.

DESCRIPTION OF OTHER EMBODIMENTS

Figure 1:
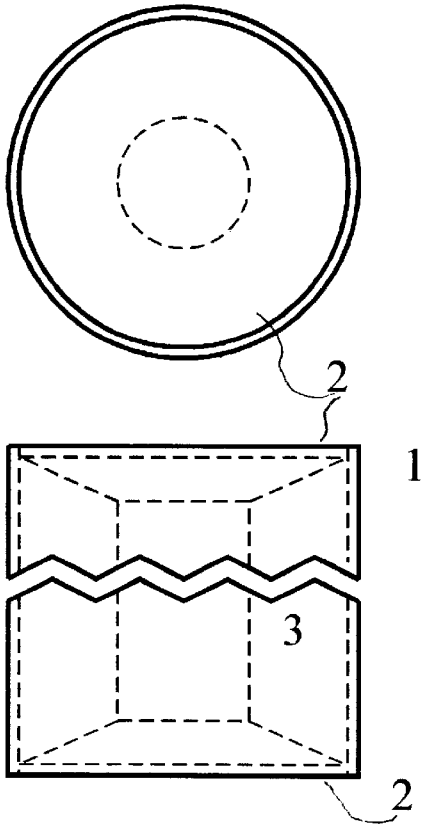
FIG. 1. This is a drawing of the ferromagnetic core parts without conductor coils and is for familiarization with the core concept.

Referring to FIG. 1. This drawing shows only the ferromagnetic core parts. All core parts can be cast, forged, machined, sintered or formed from ferromagnetic sheet material and consists of the tube #1, the end caps #2 and the center core #3. These units come in short, with a length of 1½ or less times the diameter, or in long, with a length 7 or more times the diameter. The end caps #2 and the center core #3 are not required for all configurations.

Figure 2:
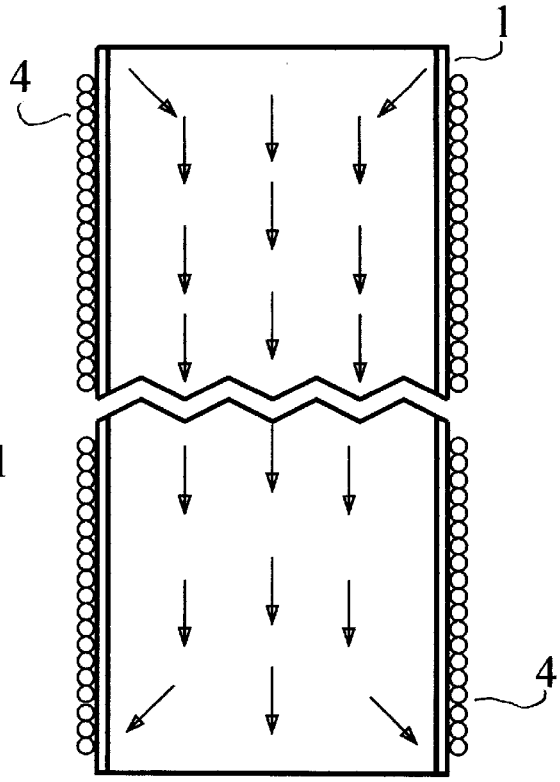
FIG. 2. This is a cross sectional drawing [split down the center] of a long tube, 7 or more times the diameter, with the conductor wound on the outside of the tube. The arrows indicate the position/direction of the magnetic field.

Referring to FIG. 2. This is a cross sectional drawing [split down the center] of the long configuration with the length 7 or more times the diameter. When an electric current passes through conductor coil #4, which is wound on the outside of tube #1, the resulting magnetic field is as indicated by the arrows and is inside of tube #1.

Figure 3:
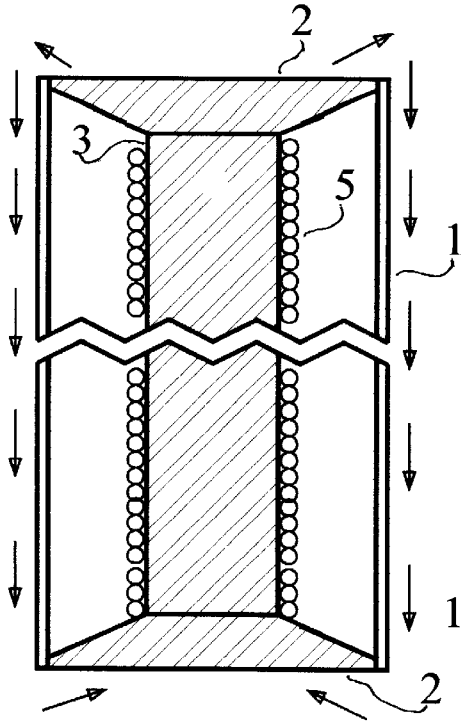
FIG. 3. This is a cross sectional drawing [split down the center] of a long tube, 7 or more times the diameter, with a conductor wound on the center post and with end caps. The arrows indicate the magnetic field location/direction.

Referring to FIG. 3. This is a cross sectional drawing [split down the center] of the long configuration with the length 7 or more times the diameter. Center post #3 is axially located inside of tube #1 with the end caps #2 in contact with the center post #3 and with tube #1 to complete the magnetic circuit. Conductor #5 is wound on center post #3. When current passes through conductor #5, wound on center post #3, placed as shown between end caps #2 that are in contact with the ends of tube #1, the resulting magnetic field is as shown by the arrows and is on the outside of tube # 1.

Figure 4:
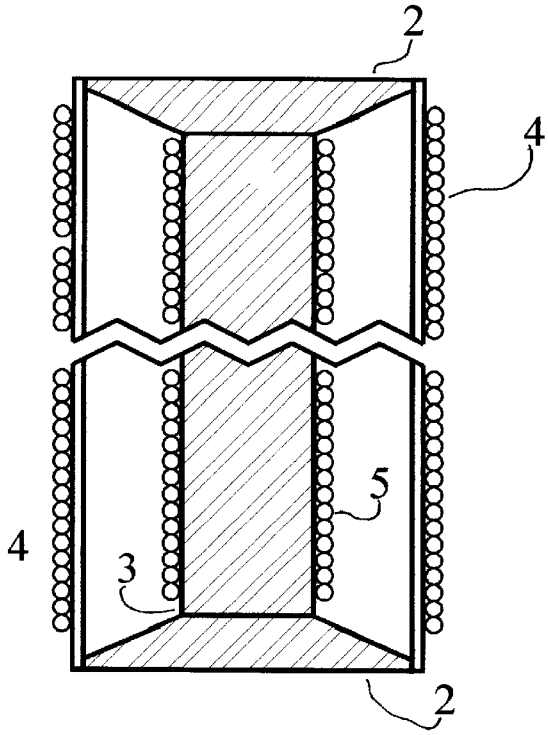
FIG. 4. This is a cross sectional drawing [split down the center] of a long tube, 7 or more times the diameter, with a conductor wound on the center post and also on the outside of the tube. These conductors can be the primary and secondary conductors of a transformer or other inductive device.

Referring to FIG. 4. This is a cross sectional drawing [split down the center] of the long configuration with the length 7 or more times the diameter. Center post #3 axially located inside of tube #1 with the end caps #2 in contact with center post #3 and with tube # completes the magnetic circuit. Conductor #5 is wound on the center post #3 and conductor #4 is wound on the outside of tube #1. When a changing electric current is passed through conductor coil #4 a changing magnetic field is established inside of tube #1 and produces a secondary current in conductor coil #5. When a changing electric current is passed through conductor coil #5 a changing magnetic field is established outside of tube #1 and then produces a secondary current in conductor coil #4. This is a transformer.

Figure 5:
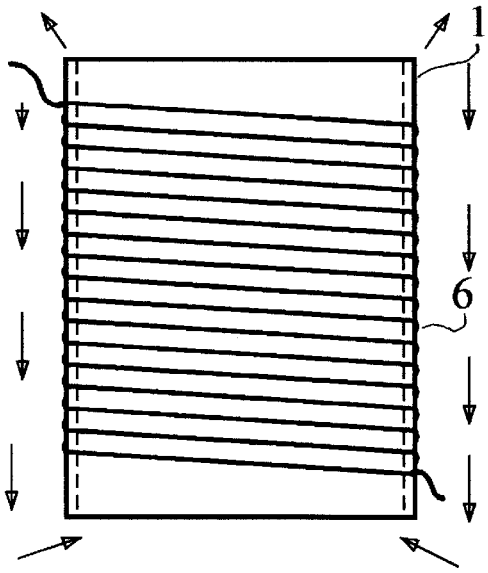
FIG. 5. This drawing is a short tube, 1½ or less times the diameter, with a conductor coiled on the outside of the tube. The arrows indicate the position/direction of the magnetic field.

Referring to FIG. 5. This is a drawing of the short configuration with a length of 1½ or less times the diameter. Current passing through conductor #6 which is wound on the outside of tube #1 produces a magnetic field almost totally on the outside of tube #1.

Figure 6:
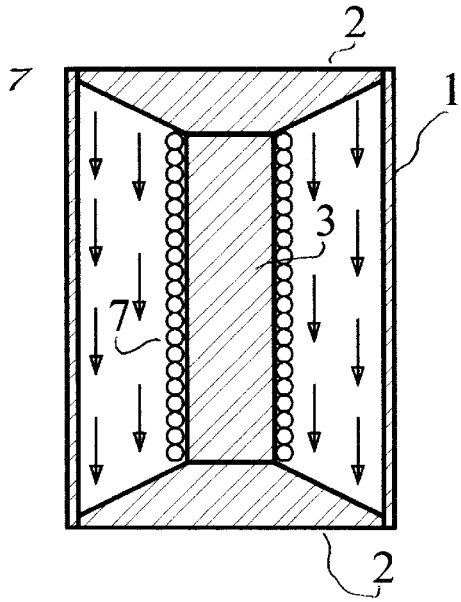
FIG. 6. This is a cross sectional drawing [split down the center] of a short tube 1½ or less times the diameter, with a conductor wound on the center post. The arrows indicate the position/direction of the magnetic field.

Referring to FIG. 6. This is a cross sectional drawing [split down the center] of the short configuration whose length is 1½ or less times the diameter. Current passing through conductor #7, wound on center post #3, produces a magnetic field inside of tube #1 as indicated by the arrows.

Figure 7:
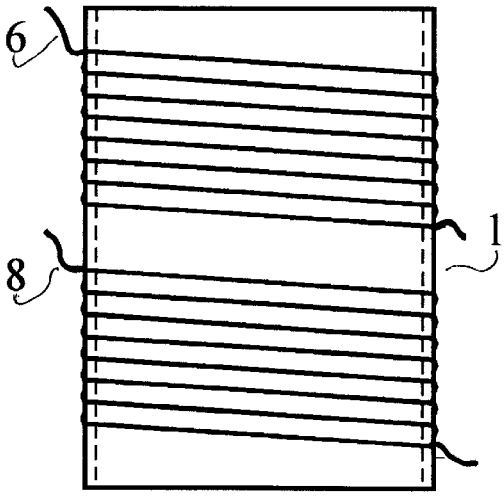
FIG. 7. This drawing is similar to FIG. 5 with the addition of a second conductor wound on the outside. This arrangement can be a transformer or other type of an inductive device.

Referring to FIG. 7. This is a short tube configuration with a length 1½ or less times the diameter. Conductors #6 and #8 are wound on the outside of tube #1. A changing electric current passing through conductor coil #6 produces a changing magnetic field on the outside of tube #1 which then produces a secondary current in conductor coil #8. A changing electric current in conductor coil # 8 produces a changing magnetic field outside of tube #1 which then produces a secondary current in conductor coil #6.

I claim:

1. A magnetic field device comprising: a ferromagnetic tube, with a length 7 or more times the diameter, a ferromagnetic center post positioned axially within said tube, two end caps connecting the center post to said tube, with a conductor wound on said center post will produce a magnetic field outside of said tube when an electric current is introduced into said conductor.

2. A magnetic field device as in claim 1, with the addition of a conductor wound on the outside of said tube will produce a secondary current in the other conductor when an electric current is introduced into the conductor on the outside of said tube or the conductor on the inside of said tube.

3. A magnetic field device as in claim 2 with the addition of a second conductor, wound on the outside of said tube will produce a secondary current in the other conductor when an electric current is introduced in either conductor.

* * * * *